United States Patent [19]

Harrison

[11] 4,132,329

[45] Jan. 2, 1979

[54] DISPENSER FOR PLASTIC CARDS

[76] Inventor: Ronald G. Harrison, 21 Cunningham Rd., Sault Ste. Marie, Ontario, Canada

[21] Appl. No.: 849,075

[22] Filed: Nov. 7, 1977

[51] Int. Cl.[2] ..... B65H 1/00

[52] U.S. Cl. ..... 221/45; 221/63; 312/60; 221/155

[58] Field of Search ..... 221/155, 61, 63, 45; 206/425, 39.5, 39.6, 39.7, 815; 211/50; 312/50, 60

[56] References Cited

U.S. PATENT DOCUMENTS

| | | | |
|---|---|---|---|
| 1,733,124 | 10/1929 | Jahn et al. | 312/60 |
| 1,944,431 | 1/1934 | Hope et al. | 312/60 |
| 2,340,561 | 2/1944 | Renfro | 312/60 X |
| 3,019,940 | 2/1962 | Sutton | 221/63 X |

*Primary Examiner*—Allen N. Knowles

*Attorney, Agent, or Firm*—David W. Wong

[57] ABSTRACT

A dispenser for plastic cards is shown, which provides a sanitary protection to the cards yet enables the cards to be dispensed singly. The dispenser comprises a generally rectangular housing having an open bottom. The side panels of the dispenser are all made of transparent plastic material so that the contents are visible. A sliding panel is slidably provided at the open bottom. The sliding panel has a length shorter than the length of the open bottom whereby a free end of the sliding panel is spaced from the lower edge of one side panel of the housing to provide a predetermined gap therebetween. The lower edge of this side panel has a slanted portion sloping upwardly away from said open bottom to provide a guiding opening in the side panel. The plastic cards are fully enclosed by the housing and they may be removed therefrom one at a time through the open bottom and the guiding opening.

9 Claims, 10 Drawing Figures

DISPENSER FOR PLASTIC CARDS

BACKGROUND OF THE INVENTION

This invention relates to an apparatus for displaying and dispensing a plurality of plastic cards, more particularly small size plastic cards having at least one acute angular corner and being usable as toothpicks.

Dispensers for cards and other small articles are well known. They provide a container for the cards or articles such that the contents may be conveniently dispensed therefrom singularly. However, known dispensers are usually complex in structure and consist of moving parts which either are difficult to operate or easily break down in use. Furthermore, they do not provide any simple means for indicating the amount of contents therein. Some dispensers have open slots formed in their side walls to provide a visible means in showing the level of contents therein. However, such openings in the side walls are not satisfactory for contents which must be stored in a sanitary condition.

OBJECTS OF THE INVENTION

The primary object of the present invention is to provide a device for dispensing plastic cards in a singulary fashion.

An object of the present invention is to provide a sanitary container for the plastic cards.

Another object of the present invention is to provide a plastic cards dispenser which is easy to operate and is simple in structure.

Yet another object of the present invention is to provide a dispenser which includes an effective means of showing the amount of contents therein.

It is a further object of the present invention to provide plastic cards which are usable as toothpicks.

SUMMARY OF THE INVENTION

Briefly, the dispenser for plastic cards of the present invention comprises a generally rectangular housing having an open bottom. A sliding panel is slidably provided at said open bottom. The sliding panel has a length shorter than the length of the open bottom whereby a free end of the sliding panel is spaced from the lower edge of one side panel of the housing to provide a predetermined gap therebetween. The lower edge of this side panel has a slanted portion sloping upwardly away from said open bottom to provide a guiding opening in the side panel. The plastic cards are fully enclosed by the housing and they may be removed therefrom one at a time through the open bottom and the guiding opening.

BRIEF DESCRIPTION OF THE DRAWINGS

Other objects and a better understanding of the present invention will become more apparent from the following description, taken in conjunction with the accompanying drawings, in which.

DETAIL DESCRIPTION OF A SPECIFIC EMBODIMENT BY WAY OF EXAMPLE

Figure 1:
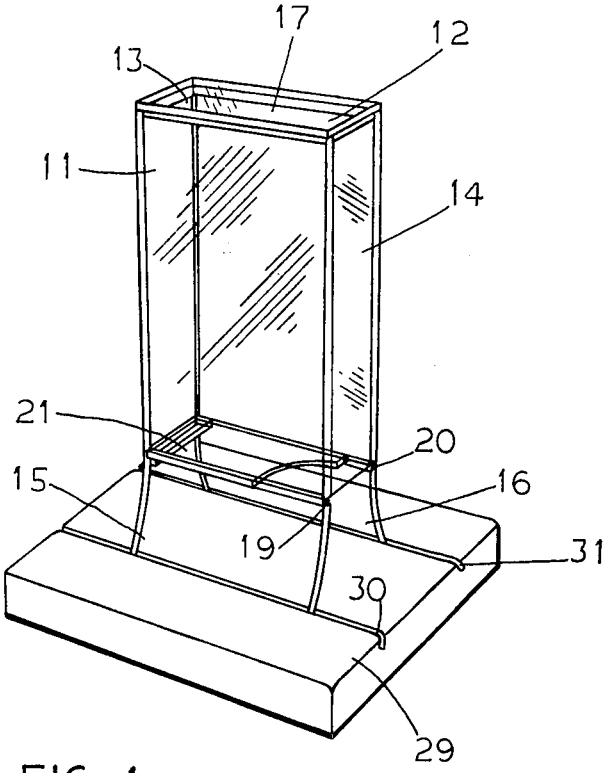
FIG. 1 is a perspective view of the dispenser according to the present invention.
Figure 5:
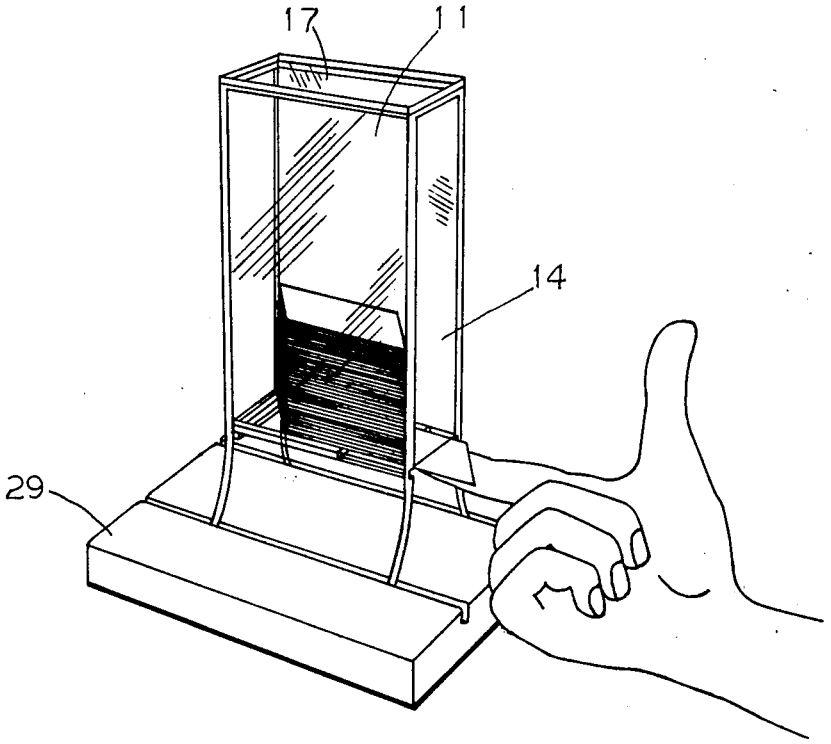
FIG. 5 is a perspective view of the dispenser showing a stack of plastic cards contained therein and being dispensed singularly.
Figure 3:
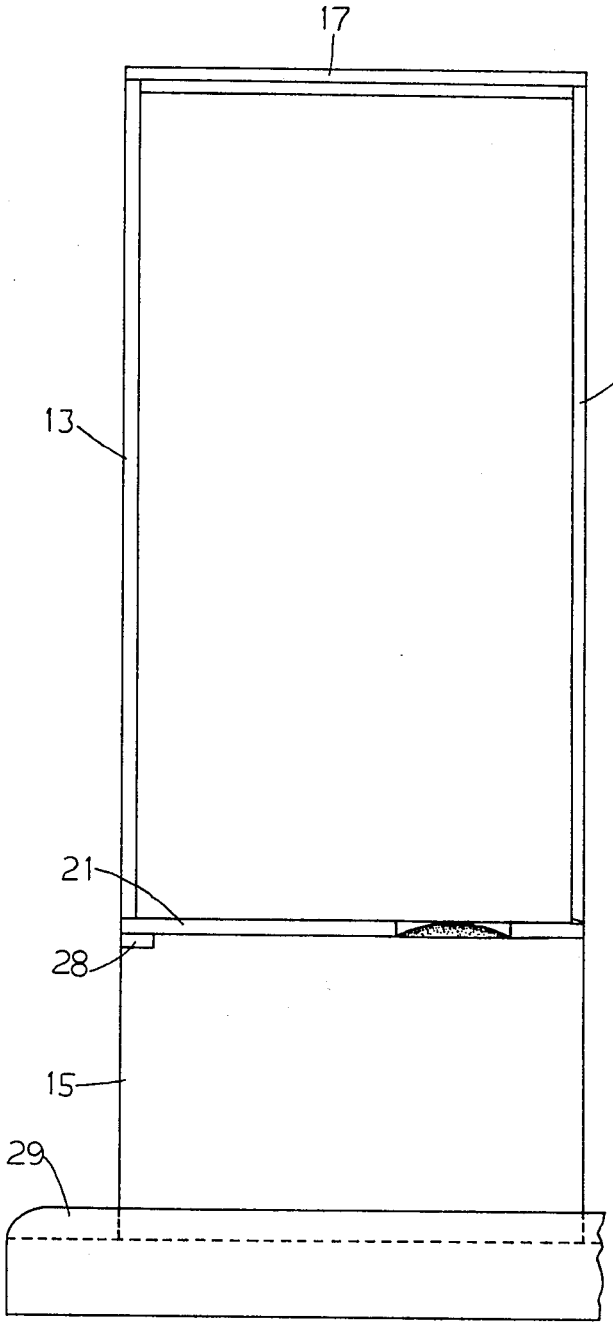
FIG. 3 is a sectional front elevation view taken along line III—III of FIG. 2.

Referring to the drawings wherein similar characters of reference represent corresponding parts in each of the several views, the dispenser is generally indicated by the reference numeral 10. It is in the form of a rectangular box or housing having mutually spaced rectangular front and rear panel 11 and 12 respectively and mutually spaced rectanggular side panels 13 and 14 respectively. The front and rear panels have lower extension portions 15 and 16 respectively extending downwardly beyond the lower edge of the side panels 13 and 14 and being bent respectively forwardly and rearwardly to form divergent legs of the housing. The top of the housing is covered by a top panel 17.

Figure 6:
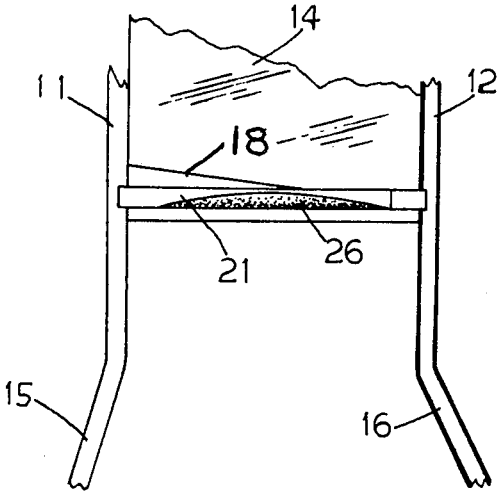
FIG. 6 is an enlarged side elevation view showing sloping portion of the lower edge of one side panel of the dispenser housing.
Figure 7:
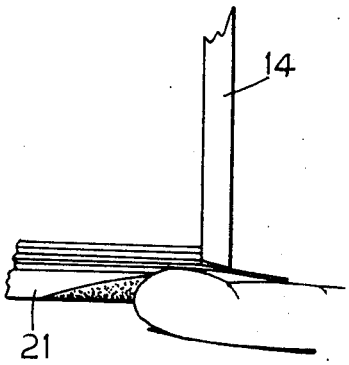
FIG. 7 is an enlarged sectional view showing the manner the plastic cards are being dispensed one at a time from the dispenser.
Figure 8:
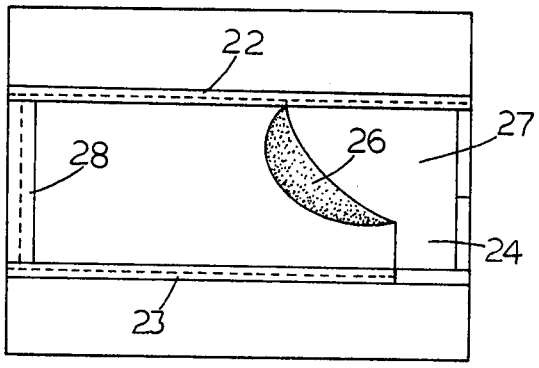
FIG. 8 is a bottom view of the dispenser showing generally the sliding panel therein.
Figure 9:
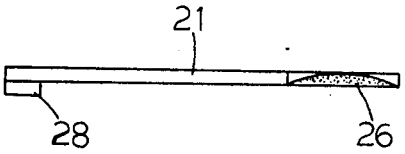
FIG. 9 is a side elevation view of the sliding panel.

The lower edge of the side panel 14 has a slanted portion 18 sloping upwardly away from the open bottom at about 15 degrees from its midpoint toward the front panel 11 as best shown in FIG. 6 so as to provide a triangular guiding opening at the side panel 14. The slanted portion 18 also slopes slightly upwardly inwardly toward the cavity of the housing as best shown in FIG. 7.

Two parallel horizontal grooves 19 and 20 are provided on the inner surface of the front and rear panels respectively. The upper edges of the grooves 19 and 20 are flush with the lower edge of the side panel 13 and the horizontal portion of the lower edge of side panel 14 while the sloping portion 18 of the lower edge of the side panel 14 is spaced from the upper edge of the groove 19 to provide the triangular guiding opening.

A sliding panel 21 is provided at the bottom of the housing. The lateral edges 22 and 23 of this sliding panel slidably and frictionally engage with the grooves 19 and 20 respectively. The length of the lateral edge 22 is about two-third the length of the groove 19 while the length of the lateral edge 23 is slightly shorter than the length of the groove 20 so that when the sliding panel 21 is fully inserted under the housing in a 'flush' position a small gap 24 about one quarter of an inch wide is provided between the longer end of the sliding panel and the side panel 14. The width of the gap 24 may be varied by adjusting the inserted position of the sliding panel 21. The friction between the lateral edges of the sliding panel and the grooves 19 and 20 maintains the sliding panel at any selected inserted position.

The end of the sliding panel 21 is curved and is provided with an arcuate bevelled portion 26 sloping towards the end so as to form a thin end edge therein. A retrieval opening 27 is defined at the bottom of the housing by the end of the sliding panel and the side panel 14 as best show in FIG. 6. In order to facilitate the removal and/or mounting of the sliding panel 21 a downwardly extending flange 28 may be provided at its straight edge end.

A base 29 may be provided for the dispenser to increase its stability. The base 29 may be made of a square or rectangular wood or plastic block having two parallel grooves 30 and 31 formed on its upper surface. The lower edges of the legs 15 and 16 may be slidably engaged within the grooves 30 and 31 respectively to secure the base removably to the dispenser.

As an example, typically the front and rear panels of the dispenser may be about 5½ inches high 3 inches wide, the divergent legs about 2 inches high and the side panels about 1 inch wide and 5½ inches high.

Figure 2:
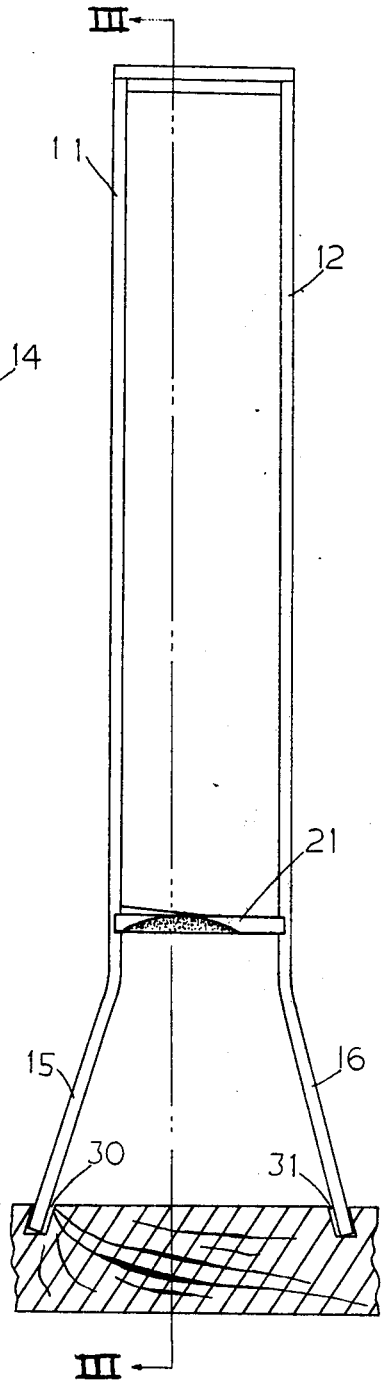
FIG. 2 is a side elevation view of the dispenser.
Figure 4:
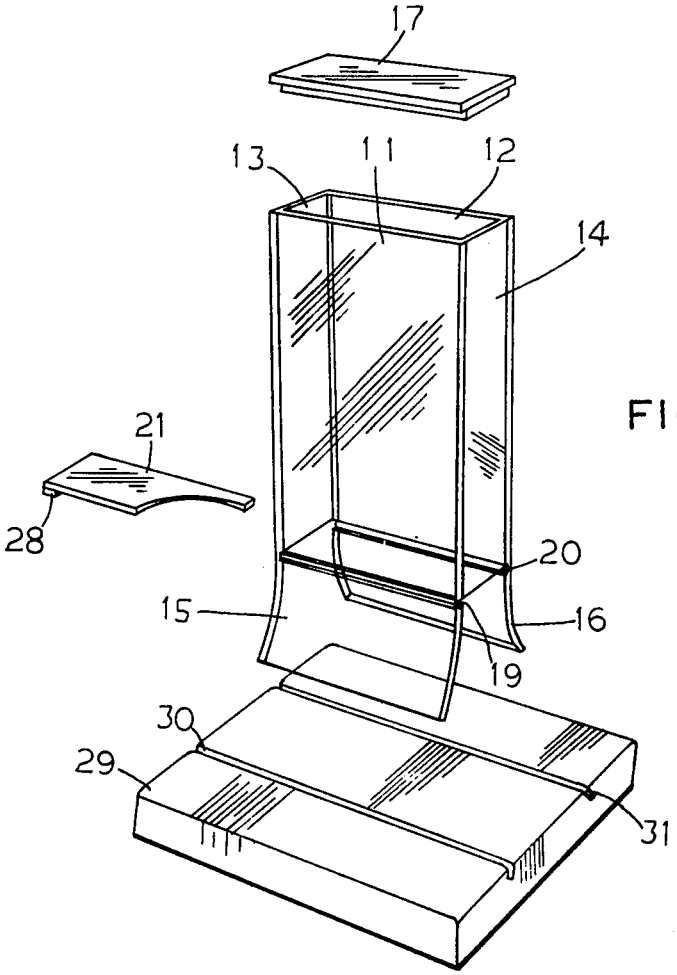
FIG. 4 is an exploded view of the dispenser showing various component parts thereof.
Figure 10:
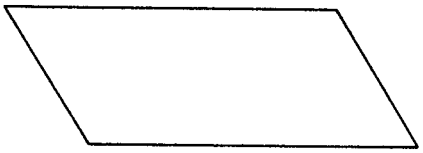
FIG. 10 is a top elevation view of the plastic card which is usable as a toothpick.

The dispenser as shown in the above exemplary embodiment is useful for storing and dispensing plastic cards such as that shown in FIGS. 2 and 10. The plastic cards may be made of thin polyvinyl chloride sheet material of about 0.010 inch thick and have a generally elongated rhomboid shape having two acute angular ends of about 60 degrees. Such plastic cards are usable as toothpicks.

In use, the cards are placed in the dispenser with one of their corners located immediately positioned neighbouring the guiding opening of the side panel. To facilitate the placement of the cards into the dispenser the cards may be packed in a small paper or other disposable box which is slightly smaller in cross sectional dimension than the cavity of the housing. One end of the box is removable to expose the cards. The exposed end of the box may be inseted upward through the open bottom of the dispenser with the sliding panel 21 already removed therefrom. When the disposable box is fully inserted into the cavity of the housing the dispenser is turned upside down and the disposable box is removed upwards leaving the plastic cards in the dispenser. The sliding panel 21 is then mounted in place and the dispenser is returned to its upright position ready for dispensing the plastic cards.

The plastic cards may be retrieved one at a time from the dispenser by placing a finger such as the index finger under the dispenser through the retrieval opening 27 to contact the lowermost card and sliding it outward towards the side panel 14 by using the friction between the finger and the card together with a gentle lifting motion. The bevelled portion 26 facilitates this operation by guiding the finger towards the card surface. The pointed acute corner of the card will be guided by the inward slope of the slanted portion 18 at the lower edge of the side panel 14 to extend outward through the triangular guiding opening. The card is also guided by the inward slope at the lower edge of the side panel 14 such that it becomes slightly arched to bend downward and to extend outward through the retrieval opening 27 and the gap 24. Due to the low surface friction between the plastic cards the second lowermost card is normally not moved by the movement of the lowermost card and any such happening is further prevented by the upward pressure of the finger applied on the lowermost card which is now arched to abut the lower edge of the side panel 14 as shown in FIG. 7 so that the cards above it are prevented from sliding outward by the lower edge of the side panel 14. The lowermost card may be fully removed by the above sliding operation or alternatively it may be pulled out after a sufficient portion of the leading edge of the acute corner has extended outwards from the side panel 14.

The panels of the dispenser according to the present invention may be made of transparent plastic material such as PLEXIGLASS (trade mark and the like so that the contents in the dispenser is clearly visible, while the fully enclosed structure provides a sanitary housing for the plastic cards contained therein.

While the invention has been particularly shown and described with reference to a preferred embodiment thereof, it will be understood by those skilled in the art that various changes in form and detail may be made therein without departing from the spirit and scope of the present invention.

What I claimed as my invention is:

1. A dispenser usable for storing and dispensing plastic cards comprising, a generally rectangular housing having an open bottom, mutually spaced front panel and rear panel provided with integral extension portions extending below said open bottom to form supporting legs therein, a sliding panel slidably mounted at said open bottom, one side panel of said housing having a lower end provided with a horizontal portion and a slanted portion sloping upwardly away from said open bottom towards said front panel, said sliding panel having an end portion provided with a cut-out end portion operatively located below said slanted portion of said one side panel, and a straight edge portion operative to abut said horizontal portion of said lower end of said one side panel when said sliding panel is fully mounted at said open bottom.

2. A dispenser according to claim 1, wherein said slanted portion of said lower end of said one side panel is bevelled to slope inwardly of the housing.

3. A dispenser according to claim 2, wherein said sliding panel has longitudinal edges slidably and frictionally engaged with two parallel grooves formed on said front panel and rear panel respectively and has a free end spaced from said side panel having said guiding opening).

4. A dispenser according to claim 3, wherein one longitudinal edge of said sliding panel is shorter than the other longitudinal edge and said cut-out portion has an arcuate edge.

5. A dispenser according to claim 4, wherein said arcuate edge is bevelled to form a thin edge.

6. A dispenser according to claim 5, wherein said sliding panel has a downwardly extending flange at the other end operative for facilitating the removal and mounting of said sliding panel at said open bottom.

7. A dispenser according to claim 6, wherein said housing is made of transparent plastic material whereby the contents therein is visible and said integral extension portions of said front panel and rear panel extending divergently below said open bottom.

8. In a dispenser according to claim 1, wherein said plastic cards are rhomboid in shape having two angular pointed ends.

9. In a dispenser according to claim 8, wherein said plastic cards are made of thin polyvinyl chloride sheet material having a thickness of about 0.010 inch.

* * * * *